US005254814A

United States Patent [19]

Harr

[11] Patent Number: 5,254,814

[45] Date of Patent: Oct. 19, 1993

[54] MOTOR OPERATOR CONNECTING MEMBER FOR PADMOUNT SWITCHGEAR

[75] Inventor: Deborah L. Harr, Columbia, Mo.

[73] Assignee: A.B. Chance Company, Centralia, Mo.

[21] Appl. No.: 928,823

[22] Filed: Aug. 11, 1992

[51] Int. Cl.[5] ..... H01H 3/00

[52] U.S. Cl. ..... 200/17 R

[58] Field of Search ..... 200/17 R, 18, 43.11–43.22, 200/47, 329, 330, 336, 337

[56] References Cited

U.S. PATENT DOCUMENTS 4,798,922 1/1989 Roberts ..... 200/400

4,804,809 2/1989 Thompson, Jr. et al. ..... 200/17 R

*Primary Examiner*—J. R. Scott

*Attorney, Agent, or Firm*—Hovey, Williams, Timmons & Collins

[57] ABSTRACT

A motor operator connecting member for padmount switchgear is provided which includes a connector and a key shiftably mounted thereon. The motor operator connecting member is adapted for selectively operatively coupling or decoupling a linear actuator and a shaft operatively connected to the switch blade of the switchgear for moving the switch blade in and out of contact with the switch contacts. The key is manually manipulable between a first position coupling the connecting member and the shaft and a second position effectively decoupling the connecting member from the shaft whereby the shaft and connecting member are free to pivot relative to one another.

13 Claims, 3 Drawing Sheets

MOTOR OPERATOR CONNECTING MEMBER FOR PADMOUNT SWITCHGEAR

BACKGROUND OF THE INVENTION

1. Field of the Invention

This invention relates to pad-mounted switchgear for high voltage underground distribution systems, and particularly to switchgear units of the type provided with a motor operator which may be actuated remotely or at the pad side to open and close the switch blade contacts.

An improved, inexpensive and highly reliable connector is provided for coupling and decoupling the motor operator from the rotatable switch blade supporting shaft to facilitate selective opening of the blade contacts or for exercising or performing maintenance on the motor operator. The connector includes a manually manipulable control member which is adapted to be actuated to couple or decouple the motor operator from the blade supportive shaft without the necessity of using tools or the like.

2. Description of the Prior Art

Underground electrical transmission and distribution systems include a main service line leading from a substation with a number of individual distribution lines connected in parallel to the main line at strategic points along the length of the latter. It is often the practice, particularly where power is supplied to a user entity such as a manufacturing facility, office building, shopping center or discrete residential development to provide padmounted switchgear in each of the lateral distribution lines connected to the main in order to allow selective de-energization of that lateral distribution line without the necessity of de-energizing all of the latter distribution lines because of opening the service main. Switchgear apparatus conventionally includes movable contacts which may be opened and closed by maintenance personnel, as well as fuse structure which protects the line from the influence of high or low level faults that may occur in one of the branch laterals. In particularly useful types of switchgear, vacuum or oil switches are employed for circuit control along with the fusing structure to minimize the overall size of the switchgear housing.

Generally, the vacuum switch contacts of padmounted switchgear as described require a snap action opening and closing mechanism to minimize arcing and assure a positive closing of the switch contacts. Actuation of the switch operating mechanism is normally accomplished by hand. In some cases, however, motor operators have been installed on the switchgear cabinet for powered actuation of the switch blade opening and closing mechanism. Recently, there has been increased interest in a switch contact actuating mechanism that is motor operated and can be activated at remote locations, as well as locally by a switch within the cabinet.

An improved motor operator for padmount switchgear is shown and described in U.S. Pat. No. 4,804,809 to Thompson et al., and is incorporated herein by reference. The motor operator connector thereof permits manual actuation in the event of motor failure or in the event the operator desires to open the switch contacts by hand. However, the motor operator thereof is somewhat expensive to construct and required a separate wrench to remove the drive element to permit manual actuation. A need has thus been perceived for a motor operator which has a simpler construction for coupling the actuator to the shaft and which allows quick and easy operative coupling and decoupling of the actuator and the shaft without the need for tools.

SUMMARY OF THE INVENTION

The present invention is directed toward meeting these needs by providing a motor operator including a connecting member which is compact, simple to construct, and interconnects the shaft and linear actuator while requiring no additional tools. The motor operator connecting member hereof is easily accessible and requires little or no maintenance, while providing a positive engagement or disengagement between the shaft operatively connected to the switching mechanism and the linear actuator.

More particularly, the present invention includes a motor operator connecting member for padmount switchgear which includes a clevis mounted on the shaft, and a key shiftably carried by the clevis for movement between a first position and a second position. In the first position, a locking end of the key is positioned in a corresponding keyway on the shaft to lock the shaft relative to the clevis. Thus, in the first position, shifting of the actuator causes corresponding movement of the clevis and pivoting of the shaft. In the second position, the key is shifted radially away from the shaft so that the locking end of the key no longer is positioned in the keyway. In this second position, the clevis and shaft are free to rotate relative to one another. When the key is in the second position, the shaft may be pivoted manually by the use of a wrench, or alternatively the linear actuator may be exercised for lubrication or other maintenance without affecting the engagement of the switch blade with its switch contacts. A leaf spring serves to either hold the key in the first position against undesired shifting or, once the key has been shifted, to hold it in the shifted position.

The motor operator connecting member of the present invention presents a simple yet effective and economical connection between the actuator and the shaft, while retaining and enhancing the ability to actuate the shaft manually. In preferred embodiments, the blade shaft mounts disks each of which has an eccentric surface that is rotatable between positions engaging either a first or a second limit switch operatively coupled to the actuator. An indicator provides a positive indication of the position of the shaft and thus the switching mechanism controlled thereby. This presents a compact relationship between the operating components for the actuator and allows existing limit switches, well known to those skilled in the art, to be positioned for ready accessibility within the motor operator housing.

DESCRIPTION OF THE PREFERRED EMBODIMENT

Figure 2:
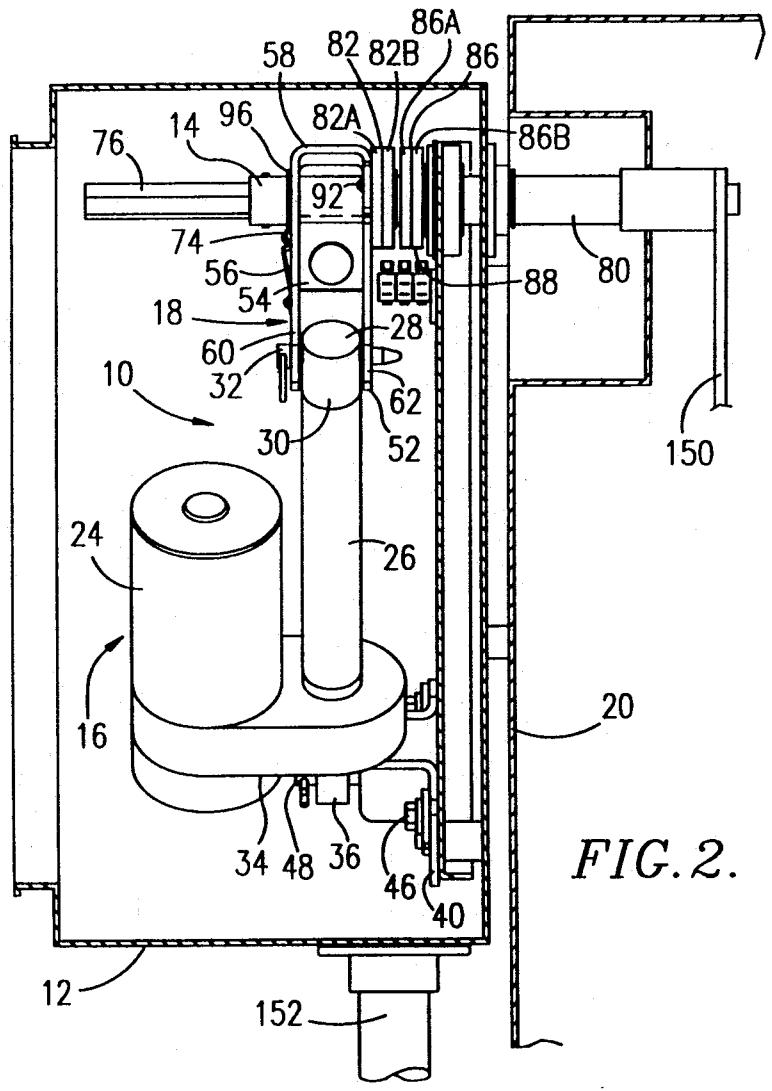
FIG. 2 is a vertical cross-sectional view taken along line 2—2 of FIG. 1 showing the linear actuator, clevis and key of the motor operator connecting member, and the shaft leading to the switching mechanism.
Figure 1:
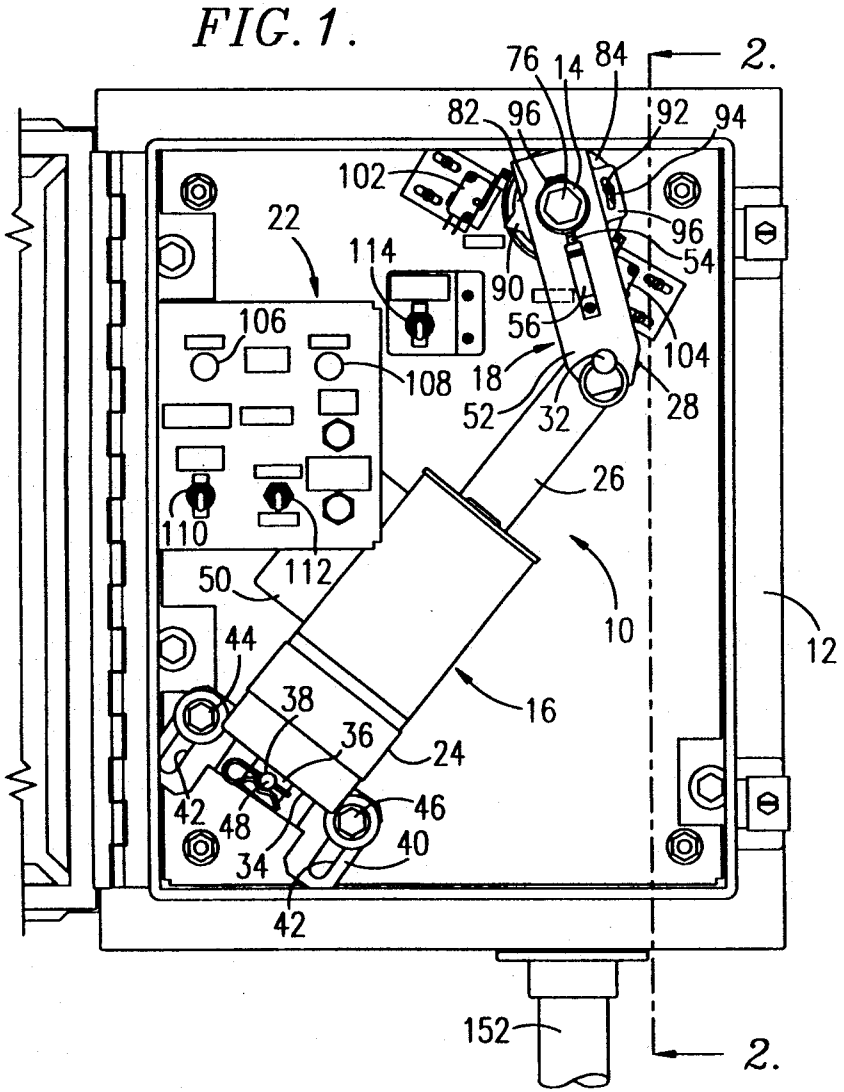
FIG. 1 is a side elevational view of the motor operator of the present invention showing the motor operator connecting member coupled to a linear actuator and mounted on the shaft operatively connected to the switching mechanism.

Referring now to the drawing, FIGS. 1 and 2 show a motor operator 10 for use with padmount switchgear. The motor operator 10 is enclosed within a housing 12 and includes a pivotally mounted shaft 14, a linear actuator 16, and a motor operator connecting member 18. The housing 12 is mounted on the side of a switching cabinet 20 as shown in FIG. 2 and in greater detail in FIG. 9. A control unit 22 is located within the housing 12 which houses the electrical controls for operation of the motor operator 10.

In greater detail, the linear actuator 16 includes a motor unit 24 which rotatably drives a screw located within tube 26. The remote end 28 of the linear actuator 16 presents a head 30 which is pivotally connected to the motor operator connecting member 18 by a quick-release pin 32 inserted through the head 30. The motor unit 24 presents a bottom end 34 opposite head 30 including an ear 36 defining an opening 38. An actuator mounting bracket 40 includes slots 42 which receive bolts 44 and 46 therethrough for adjustably mounting the motor unit 24 to the housing 12. The actuator mounting bracket 40 also mounts pivot pin 48 which extends through the opening 38 to pivotally mount the motor unit 24 thereon. The motor unit 24 also includes a round capacitor 50 which provides a temporary power increase during actuation of the linear actuator 16. An exemplary linear actuator useful in conjunction with the present invention is available as Model MC 42 from the Special Products Division of Hubbell Corporation of Kenosha, Wis.

Figure 3:
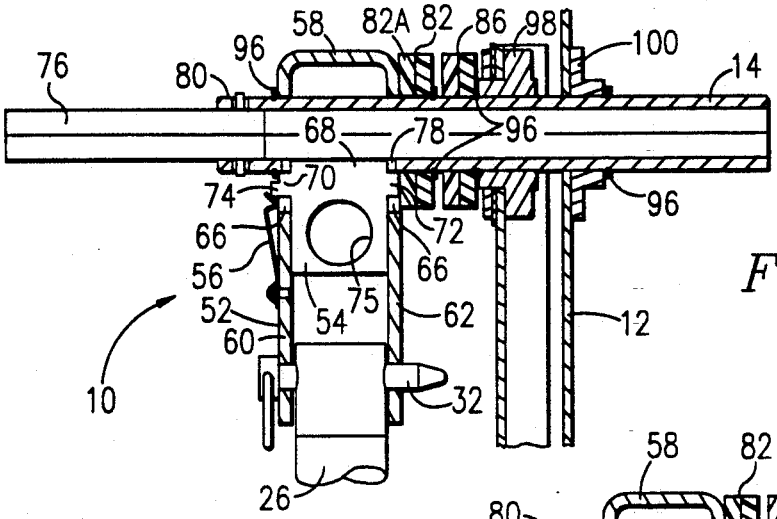
FIG. 3 is an enlarged, fragmentary, vertical cross-sectional view of the motor operator connecting member hereof, showing the key in the first position coupling the connecting member to the shaft.
Figure 4:
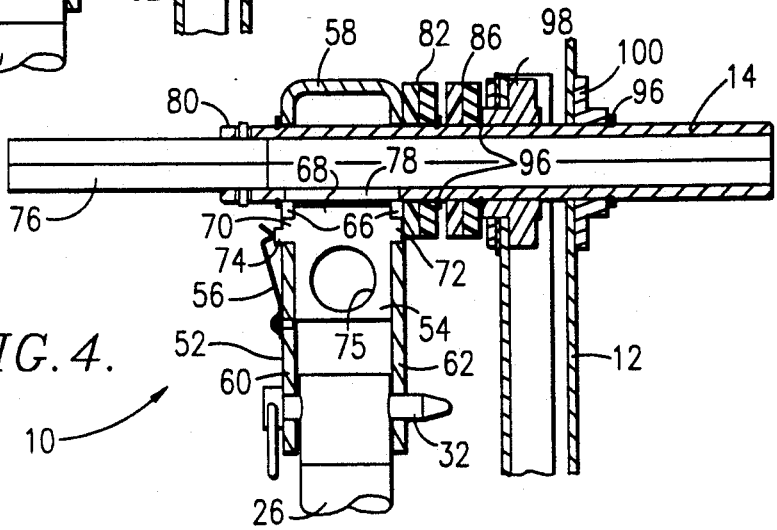
FIG. 4 is an enlarged, fragmentary, vertical cross-sectional view similar to FIG. 3 but showing the key in the second, disengaged position.

The motor operator connecting member 18 broadly includes connector or clevis 52, key 54 shiftably carried by the clevis 52, and leaf spring 56 which is secured by a set screw at one end thereof to arm 60 of the clevis 52. The leaf spring 56 serves to retain the key 54 in a desired position. Clevis 52 is mounted to the shaft 14 and includes a bight portion 58 and arms 60 and 62. The arms 60 and 62 are pivotally connected to head 28 by quick-release pin 32. Each arm includes an aperture 64 for receiving shaft 14 therethrough and a slot 66 positioned radially outwardly from the shaft 14 for shiftably retaining key 54. The locking end of key 54 presents a finger 68 which extends radially inwardly toward shaft 14 and a pair of laterally extending shoulders 70 and 72 which are located in the slots 66 of arms 60 and 62. Shoulder 70 includes a tang 74 which engages the unsecured end of leaf spring 56 so that the key 54 is held in its first, radially inward position as shown in FIG. 3. When the key 54 is moved radially outwardly on clevis 52 to its second position as shown in FIG. 4, the unsecured end of leaf spring 56 presses against the tang 74. Key 54 also includes an opening 75 sized to receive a human finger therein for manually manipulating the key 54.

Shaft 14 presents a laterally extending hex shaft 76 pinned thereto at one end thereof, hex shaft 76 being adapted for receiving a wrench thereon. An exemplary wrench for such use is shown as wrench 126 in U.S. Pat. No. 4,804,809, incorporated herein by reference. Shaft 14 also includes a keyway 78 for receiving finger 68 when key 54 is in the first position. Shaft 14 includes a hexagonal interior surface complimental to and opposite hex shaft 76 and presents a cylindrical exterior surface 80, whereby clevis 52 is mounted for pivoting relative to the shaft 14 when the key 54 is shifted into the second position as shown in FIG. 4.

A first pair of disks 82 each presenting an eccentric surface 84 is fixed to clevis 52 and a second pair of disks 86 each presenting an eccentric surface 88 are fixed to the shaft 14 for rotation therewith, with each of the first pair of disks 82A and 82B including a pointer 90 for providing a visual indication of the pivotal position of the clevis 52. In that regard, the disks 82A and 82B are held together by a machine screw 92 which extends axially through a slot 94 in a flange 96 on clevis 52. Each disk 86A and 86B of second pair of disks 86 also include a pointer (not shown) which provides a visual indication of the position of the shaft 14. Disks 86A and 86B are fixed to shaft by radially inwardly extending Allen head set screws (not shown). Clevis 52, disks 86A and 86B, and discs 82A and 82B are axially positioned on cylindrical exterior surface 80 by retaining rings 96. Cylindrical exterior surface 80 and thus shaft 14 are pivotally supported on housing 12 by bearings 98 and 100.

The eccentric surface 84 of first pair of disks 82 is positioned to engage a follower on first limit switch 102 when clevis 52 is located in the open position. When the clevis 52 is in the closed position, eccentric surface 84 engages the follower on second limit switch 104. When shaft 14 is located in the closed position, eccentric surface 88 engages the follower on limit switch 104, and when shaft 14 is located in the open position, eccentric surface 88 engages the follower on limit switch 102. Both first limit switch 102 and second limit switch 104 are comprised of a stack of three double-throw, spring-biased switches and are operatively connected to motor unit 24 of the linear actuator 16.

Control unit 22 within housing 12 includes a normally "open" push button switch 106 for initiating shifting of the linear actuator 16 to open the contacts of the switchgear, and "close" push button switch 108 for initiating shifting of the linear actuator 16 to close the contacts of the switchgear. A power switch 110 for providing or preventing power to the linear actuator 16 is provided, as well as a switch 112 for selecting local or remote operation. For example, with the switch 112 in the "local" position, the operation of the motor operator 10 is controlled from within the housing 12, while in the "remote" position, operation of the motor operator 10 is controlled remotely by a signal received by microwave transmission or another source of telecommunications.

In addition, an "exercise motor" switch 114 is provided for cycling the motor for maintenance or lubrication when the key 54 is shifted into the second position.

Figure 9:
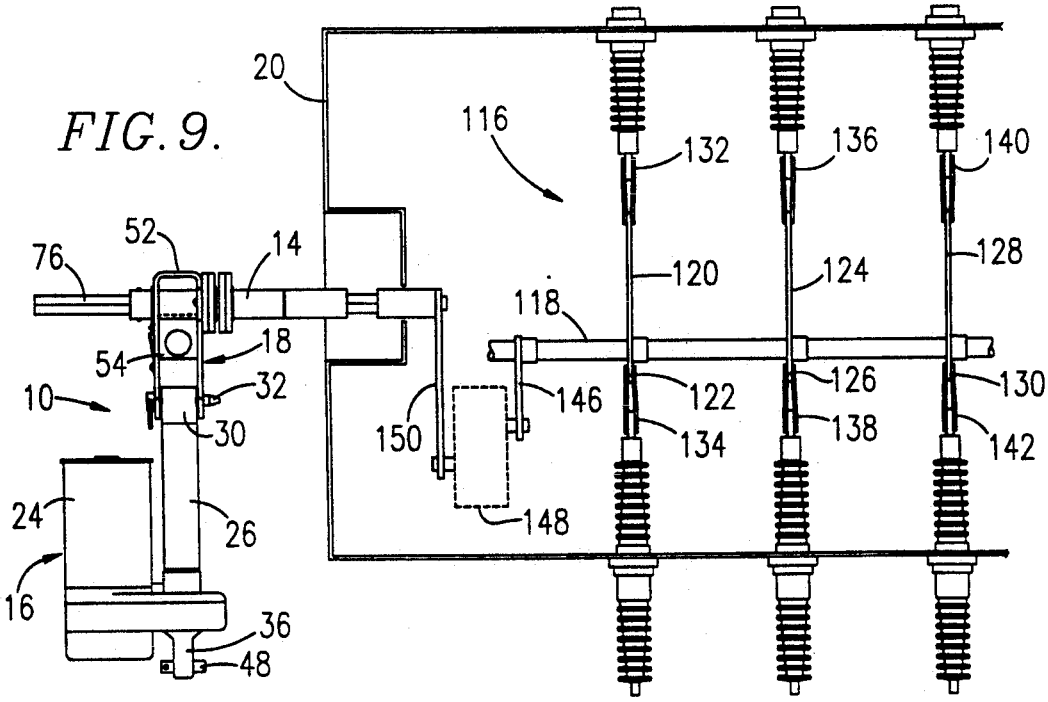
FIG. 9 is a fragmentary view of the padmount switchgear showing the operative connection between the shaft and the switch blades and switch contacts of a three-phase power transmission line.

The motor operator 10 operates in conjunction with padmount switchgear 116 as broadly illustrated in FIG. 9. The switchgear includes a main shaft 118 carrying a first integral pair of switch blades 120 and 122, a second integral pair of switch blades 124 and 126, and a third integral pair of switch blades 128 and 130, the switch blades respectively engaging contacts 132, 134, 136, 138, 140, and 142 when main shaft 118 is in its closed position. FIG. 9 is a fragmentary view showing one three-phase group of contacts and switch blades, and it should be understood that additional groups of contacts and switch blades can be added to support additional lines. Main shaft 118 is connected by a crank arm 146 to a spring actuated latch, load and trip mechanism 148 shown in phantom. The mechanism 148 provides for quickly initiating pivoting of the main shaft 118 when actuated by the movement of shaft 14 and link arm 150. An exemplary mechanism 148 is shown, for example, in U.S. Pat. No. 4,798,922, the disclosure of which is incorporated herein by reference.

In operation, 3-phase electrical current is carried in underground transmission lines at, for example, 15.5 Kv and 600 amperes and is carried between contacts 132 and 134 by the first integral pair of switch blades 120 and 122, between contacts 136 and 138 by the second integral pair of switch blades 124 and 126, and between contacts 140 and 142 by the third integral pair of switch blades 128 and 130. During normal operation, key 54 is located in the first position shown in FIGS. 3 and 5 with finger 68 located in keyway 78 to engage shaft 14.

Upon receipt of a remote signal to open the contacts when switch 112 is in the "remote" position, or when the push button switch 106 is depressed with the switch 112 in the "local" position, power is supplied from conduit 152 to the linear actuator 16 whereby the motor 24 begins to extend head 28. Because the key 54 is engaged with the shaft 14, the linear actuator 16 is thus operatively coupled to the shaft 14 so that extension of the head 28 serves to pivot clevis 52 and thereby pivot shaft 14. When the head 28 reaches a predetermined position (i.e., the shaft 14 has completed the desired pivotal movement and the switch blades have moved out of engagement with respective contacts in the switch housing), motor 24 is deactivated by internal limit switches thus ending further pivotal movement of the shaft 14. The eccentric surface 88 turns with the shaft 14 and at the predetermined position moves the follower of limit switch 102 into a depressed position thereby providing a means to sense the open position of shaft 14 and to inhibit action of a "close" signal until the "open action is complete. When the contacts are again closed by initiating linear actuator to retract head 28, the shaft 14 rotates until the original position is reached. The eccentric surface 88 moves the follower of limit switch 104 into a depressed position, thereby providing a means to sense the closed position of shaft 14 and to inhibit action of an "open" signal until the "close" action is complete.

Figure 6:
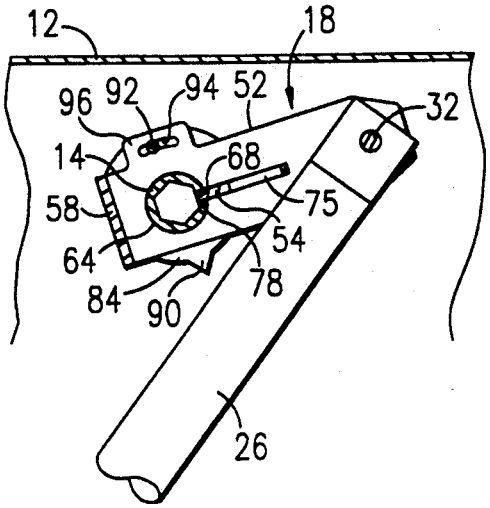
FIG. 6 is a diagrammatic view similar to FIG. 5 with the key in the first position but with the actuator extended to place the switching mechanism in the open position.
Figure 7:
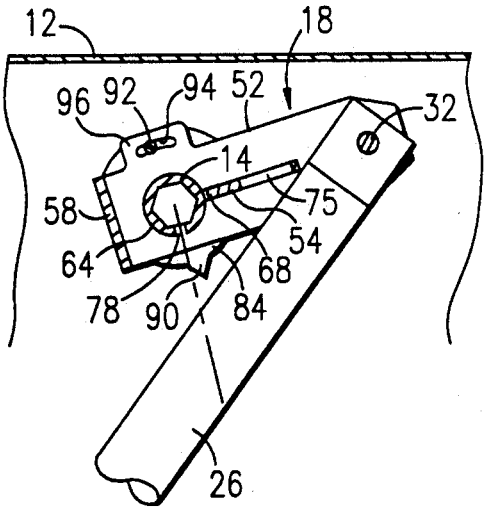
FIG. 7 is a diagrammatic view similar to FIG. 6 but with the key in the second, disengaged position for permitting exercising of the actuator without pivoting the shaft.
Figure 8:
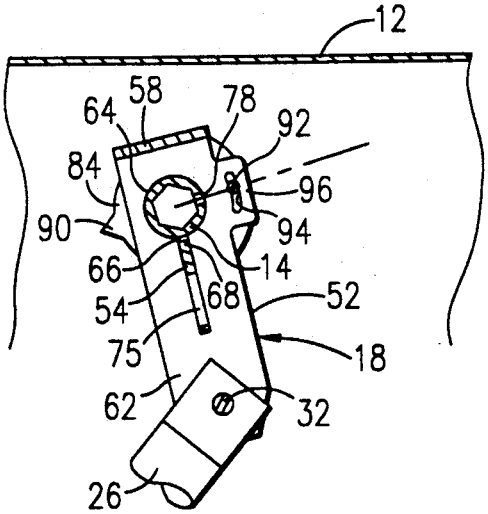
FIG. 8 is a diagrammatic view similar to FIG. 5 but with the key in the second, disengaged position and the shaft manually shifted into the open position.

Upon rotation of shaft 14 into the position shown in FIG. 6, the link arm 150 trips mechanism 148 to pivot the main shaft 118 and thus open the circuit so that current cannot flow between the respective pairs of contacts. In the event it is desired to open the contacts manually, key 54 may be manually shifted by the person inserting his finger into opening 75 and thereby shifting the key 54 into the second, radially outward position illustrated in FIG. 4. When the key 54 is thus shifted, the finger 68 thereof is no longer positioned in the keyway 78 and the shaft 14 may be rotated by turning a wrench engaging hexagonal surface 76. The shaft 14 then rotates independently of the clevis 52 and linear actuator 16 as shown in FIG. 8, whereby link arm 150 trips mechanism 148 to pivot the main shaft 118 and thus opens the circuit.

Similarly, it may be desirable to exercise the linear actuator 16 without opening or closing the contacts. This may be accomplished by shifting the key 54 radially outwardly on the clevis 52 into the position indicated in FIG. 4 so that the key finger 68 is no longer within the keyway 78. After switch 114 is thrown, switches 106 and 108 may be used to permit movement of the linear actuator which may have been idle for an extended period of time.

Figure 5:
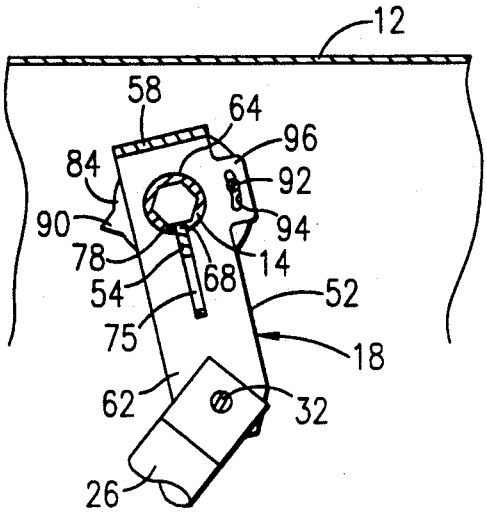
FIG. 5 is a diagrammatic view of the motor operator connecting member hereof showing the key in the first position with the actuator retracted placing the switching mechanism in the closed position.

The pointers 90 are useful for determining the position of the shaft 14 and the clevis 52. With the key 54 engaged in the first position shown in FIG. 3, the pointers 90 point left and slightly down as depicted in FIGS. 1 and 5 when the contacts are closed, and down and slightly right as shown in FIG. 6 when the contacts are open. If the key 54 is shifted radially outwardly into the second position shown in FIG. 4, shaft 14 may pivot relative to the clevis 52, and if the pointers on the first pair of disks are not aligned with the pointers on the second pair of disks, this indicates that the key 54 is not in the first position and cannot be shifted into the first position until they are aligned.

I claim:

1. In switchgear having a movable switch blade and contacts engaged thereby, a shaft operatively connected to the switch blade for moving the latter out of and into engagement with said contacts, a motor operator having a shiftable actuator, and means for connecting said motor to a source of power, the combination therewith of:

means for connecting said actuator to said shaft, said connecting means including manually manipulable means shiftably mounted for movement between a first shaft-engaging position whereby shifting of actuator serves to pivot said shaft and a second, disengaged position whereby said shaft may be pivoted independently of said actuator and the connecting means.

2. A switchgear as set forth in claim 1, wherein said manually manipulable means is mounted for finger movement without the need for tools.

3. A switchgear as set forth in claim 2, wherein said manually manipulable means includes a key and said shaft includes a keyway for receiving said key therein when said key is shifted into said first position.

4. A switchgear as set forth in claim 3, wherein said key includes an opening sized to receive a human digit therein.

5. A switchgear as set forth in claim 4, wherein said connecting means comprises a clevis presenting a pair of opposed arms, each of said arms including a slot for receiving said key therein.

6. A switchgear as set forth in claim 5, said connecting means including a quick-release pin for coupling and decoupling said clevis to said actuator.

7. A switchgear as set forth in claim 1, including an eccentric mounted on said shaft, and first and second limit switches operatively connected to said actuator and positioned for selective engagement with said eccentric.

8. A switchgear as set forth in claim 3, including means for retaining said key means in said first shaft-engaging position and alternatively said second disengaged position.

9. A switchgear as set forth in claim 8, wherein said retaining means comprises a yieldable member for engaging said key means.

10. A motor operator for switchgear, said switchgear including switch contacts, a switch mechanism including a pivotally mounted shaft operatively coupled to said switch contacts for opening and closing the latter, and moveable linkage means coupled with said mechanism for causing selective shifting movement thereof to effect opening or closing of the switch contacts in response to movement of the linkage means, said motor operator comprising:

a linear actuator;

a connector operatively coupled to said linear actuator and mounted on said shaft; and a key shiftably mounted on said connector for movement between a first position effectively coupling said shaft to said connector and a second position effectively decoupling said connector and said shaft.

11. A motor operator as set forth in claim 10, said connector including a clevis presenting a pair of opposed arms for receiving said key therebetween for radially shiftable movement toward and away from said shaft.

12. A motor operator as set forth in claim 10 wherein said key is mounted on said connecting member for manual manipulation between said first and second positions.

13. A motor operator as set forth in claim 12 wherein said key includes an opening sized to receive a human digit therein.

* * * * *